US006096107A

United States Patent [19]

Caracostas et al.

[11] Patent Number: 6,096,107

[45] Date of Patent: Aug. 1, 2000

[54] SUPERABRASIVE PRODUCTS

[75] Inventors: Constantinos A. Caracostas, Athens, Greece; Richard M. Andrews; Bradley J. Miller, both of Westborough, Mass.

[73] Assignee: Norton Company, Worcester, Mass.

[21] Appl. No.: 09/476,506

[22] Filed: Jan. 3, 2000

[51] Int. Cl.[7] ..... B24D 3/02; B24D 3/06; B24D 3/08; B24D 3/10

[52] U.S. Cl. ..... 51/297; 51/307; 51/293

[58] Field of Search ..... 51/297, 307, 309, 51/293; 407/32; 75/243, 244

[56] References Cited

U.S. PATENT DOCUMENTS

| | | | |
|---|---|---|---|
| 2,292,991 | 8/1942 | Crompton, Jr. | 51/293 |
| 3,744,355 | 7/1973 | Dawson et al. | 51/309 |
| 4,229,186 | 10/1980 | Wilson | 51/309 |
| 4,256,467 | 3/1981 | Gorsuch | 51/295 |
| 5,014,468 | 5/1991 | Ravipati et al. | 51/309 |
| 5,066,312 | 11/1991 | Ishak et al. | 51/295 |
| 5,081,798 | 1/1992 | Clasen | 51/295 |
| 5,131,924 | 7/1992 | Wiand | 51/309 |
| 5,152,917 | 10/1992 | Pieper et al. | 51/309 |
| 5,840,088 | 11/1998 | Yang et al. | 51/295 |
| 5,863,306 | 1/1999 | Wei et al. | 51/295 |

FOREIGN PATENT DOCUMENTS

| | | | |
|---|---|---|---|
| 0 263 785 B1 | 4/1988 | European Pat. Off. | B24D 3/06 |

*Primary Examiner*—Michael Marcheschi
*Attorney, Agent, or Firm*—David Bennett

[57] ABSTRACT

Coated abrasives with engineered abrasive surfaces are produced using superabrasive particles mixed with metal particles in a cold-forming process.

12 Claims, 1 Drawing Sheet

SUPERABRASIVE PRODUCTS

BACKGROUND OF THE INVENTION

This invention relates to superabrasive products and particularly to products having the form of a coated abrasive.

The term "superabrasive" is conventionally used to refer to materials with great hardness and toughness that can be used to abrade very hard materials without suffering significant polishing of the cutting edges or fracture of the abrasive particles. Superabrasives are typified by cubic boron nitride, ("CBN"), and diamond. Because they are able to abrade intractable materials such as glass, ceramics, marble, stone, and very hard metals, they are frequently held in metal bonds to ensure this quality is not compromised by bonds of inadequate strength for such purposes. The abrasive is sometimes electroplated to a substrate, perhaps through a mask to produce isolated islands of abrasive having either a single grain or a plurality of superabrasive crystals within each said island. However electroplating has disadvantages in the absence of adhesion between the bond and the abrasive particles. Said superabrasive grains can also be adhered to a substrate by means of brazing which greatly increases the retention of the grains with concomitant increase in abrading performance.

While superabrasives are significantly more expensive than conventional abrasives, their potential longevity and the precision and finish of the surface obtained on tough materials is sufficiently attractive to make their use a subject of continuing interest.

Another current interest in the field of coated abrasives is the use of engineered abrasives in which the abrading surface is provided by a plurality of composites with abrasive grits dispersed in a cured resin matrix. The shape and size of the composites can be engineered to provide any desired level of cutting and/or surface finish. Such products are exemplified by U.S. Pat. Nos. 5,014,468; 5,152,917; 5,833,724; 5,840,088 and 5,863,306.

The present invention lies at the confluence of these trends and provides a means to secure the advantages of superabrasives in the context of an engineered abrasive surface.

DESCRIPTION OF THE INVENTION

The present invention provides a process for the production of an engineered abrasive which comprises:

a) forming a mixture of particles of a superabrasive and particles of a metal or metal alloy;

b) depositing the mixture as a layer on a metal foil supported on a rigid surface;

c) applying pressure to the powder by means of a forming tool having a raised surface pattern the applied pressure being sufficient to cause the powder and the metal foil to form a coherent sheet having first and second major surfaces wherein the first surface has a raised pattern comprising a plurality of metal/superabrasive composites wherein the pattern is the inverse of the pattern on the forming tool, and the second surface is smooth; and d) densifying the metal particles in the composites to a porosity of the structure that is less than 20%.

In a preferred embodiment the second surface of the metal foil, (the surface opposite to the first surface having the patterned surface), is laminated a substrate or carrier material.

In a preferred process the support surface and the forming tool are supplied by a pair of rolls one of which has a smooth surface and the other has a surface that is patterned. This preferred process is a therefore a variation of a powder roll compaction process.

In the process of the invention metal particles are forced into contact one with another under very high pressures such that the particles deform and interlock to give the compacted powder a degree of physical integrity. In the present invention this is described as forming a "coherent" which is understood to mean a sheet that can undergo the physical manipulation required to transport the sheet to a location at which the metal particles can be sintered or brazed together permanently without disintegrating.

Generally such processes are known as "cold forming" and embraces processes in which the forming is done with the metals still in the solid state and under the influence of very high pressures. While the preferred processes operate at ambient temperatures, there is often advantage in operating at temperatures up to 200–300° C. where pressures that are somewhat lower may be adopted. With such higher temperature processes it is often possible to use only a very mild sintering conditions to achieve the requisite degree of physical integrity and strength for the final product to function as an abrasive. It is understood that all such processes are embraced under the term "cold forming" for the purposes of this Specification.

In some cases difficulties are experienced in achieving structural cohesion, (at a level adequate to survive physical manipulation prior to sintering), by the use of pressure alone. This could be either as a result of the volume of superabrasive in the powder used or the flow resistance of the metal particles. In that event it is possible to use a temporary binder to help hold the particles together until the metal particles can be sintered together. However such temporary binders carry a penalty in that they must be removed before sintering to avoid the creation of organic residues or excessive amounts of porosity in the finished product. Thus careful and possibly drawn-out heating regimes must be adopted to successfully employ temporary binders.

The cold forming process can be facilitated by the addition of minor amounts, (less than 5% and usually about 1 or 2% by volume based on the powder formulation), of a lubricant such as an oil or a wax to facilitate the relative movement of the particles as the pressure brings about powder compaction. When the particles have been forced to occupy something like the minimum space their dimensions permit, the only response to further pressure is for the metal particles to deform. The deformation of the metal particles reduces the porosity between the particles and gives the structure dimensional coherence. The pressures involved are high such as for example 15 to 50 tons/square inch, (207 to 690 MPa), and the exact level depends on the nature of the metal powder particles some of which are softer than others. For example bronze powders are relatively soft by comparison with iron or nickel based powders. In the preferred process using a pair of nip rolls, the pressures during the roll forming process can be controlled by the rolling conditions (nip angle, powder/foil feed rate, powder properties, etc.).

The proportion of superabrasive particles in the powder mixture clearly impacts on the pressures require to obtain the cold forming effect since these particles are resistant to plastic flow. Thus higher proportions of the superabrasive require higher forming pressures and to some extent may even limit the utility of this procedure. In general however cold forming is useful with superabrasive concentrations of up to 50 vol % though preferably the volume percentage of superabrasive lies in the range of 5 to 40 vol % and more preferably 15 to 35 vol % all based on the volume of the powder mixture.

The superabrasive particles used in the process of the invention generally have volume average particle sizes below about 100 micrometers, such as from 1 to 50 and more preferably from 5 to 20 micrometers. Clearly the smaller the superabrasive particles, (for a given volume ratio of metal particles to superabrasive particles), the more readily are the composites cold formed since the metal particles can more readily flow around them. In addition smaller particles lead to better surface finishes on substrates ground using such superabrasives and this is generally a very desirable result.

The metal powders are conveniently metal powders formed from copper/tin alloys such as those comprising from 5 to 50% tin and more preferably from 5 to 25% tin. However other metal powders such as iron, cobalt, nickel, titanium and mixtures thereof are also found to be very suitable for use in the process of the invention. Other metal powders that can be used are well known in the art of making superabrasive tools are equally suitable in this invention.

The size of the metal particles is preferably no coarser than the superabrasive particles and preferably are smaller, to facilitate uniform distribution of the superabrasive in the mixture. In addition it should be noted that the smaller the particles, the more compressible they are and thus the higher the green strength, (or cold formed strength prior to sintering). Thus smaller particles are preferred.

In the process of the invention cold forming occurs while the powder mixture is in contact with a metal foil and between the surfaces used to generate the cold forming pressure. The foil is preferably of a metal compatible with the metal particles in the powder mixture and may even be identical. The term "compatible" is understood to mean that under sintering conditions the metal particles present in the composites become sintered to the metal foil and form a structural unity. More usually however the metal foil has a melting point that is at least a little higher than the metal particles, such as at least 100° C., and preferably at least 200° C. higher, such that the subsequent sintering operation does not cause significant deformation of the foil.

After the powder mixture has been cold formed it is advanced to a sintering stage at which the shaped product passes into a furnace heated to a temperature that is above the temperature at which the metal particles begin to metallurgically bond to each other and in effect sinter together to form a coherent structure. The temperature of the sintering operation depends on the nature of the metal powders employed. Bronzes for example, depending on the formulation, can be sintered at temperatures of from 500 to 750° C. whereas iron based metal alloys require temperatures of from about 700 to 950° C. The sintering is preferably continued until the porosity of the cold formed material has been reduced to below about 20% and preferably to from 0 to 5%.

In conventional metal-bonded superabrasive articles in which the abrasive grains are held merely by physical entrapment, it has been found advantageous to add a reactive element to the metal matrix composition that forms a chemical bond between the metal and the grain. Such reactive elements are well know to those practiced in the art and include the carbide and nitride forming metals such as Ti, Zr, Cr, Hf, Nb, Si, Ta. This is described for example in U.S. Pat. Nos. 5,976,205; 5,832,360; and 5,486,269.

Following the sintering the metal foil beanng the sintered composites May be sufficiently strong to be used as it stands. However in a preferred process the metal foil with the patterned surface is laminated to a suitable backing material. This can be a polymeric (such as a polyester) film, a woven fabric, a flexible metal mesh or even a rigid structure such as a wheel hub. Lamination can be accomplished using a bond material or using a brazing technique where a metal rim wheel is to be produced. In some circumstances the formation of such a rim wheel can be accomplished at the same time as the sintering operation in the process of the invention.

DESCRIPTION OF PREFERRED EMBODIMENTS

Figure 1:
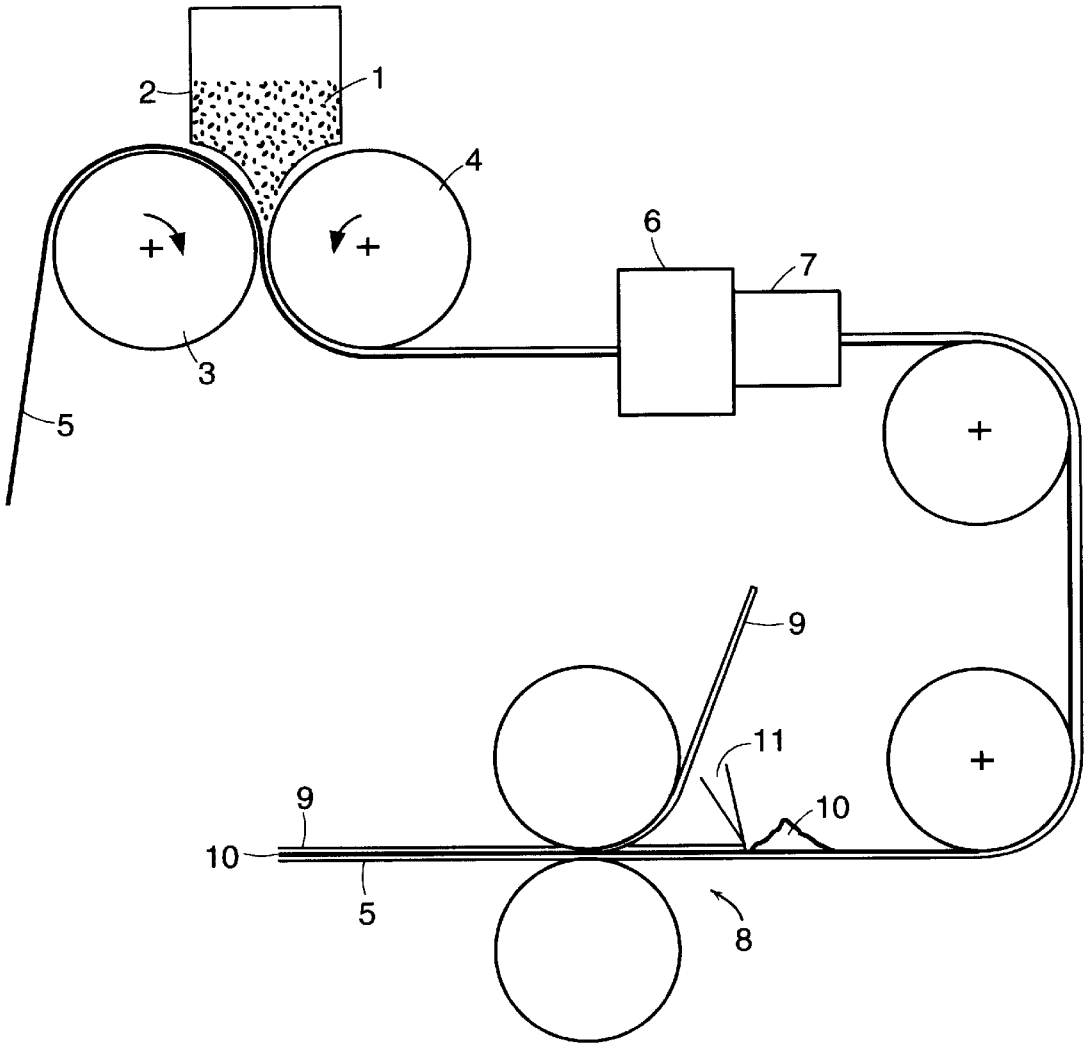
FIG. 1 is flow chart of an apparatus used to carry out cold forming according to the invention.

The invention is now illustrated with particular reference to the apparatus illustrated in FIG. 1 which is understood to be for illustrative purposes only and does not imply any essential limitation on the invention or the scope of its utility in all circumstances.

In FIG. 1 a metal /superabrasive particle mixture, 1, is fed from a hopper, 2, into the nip of a pair of cold-forming rolls of which a first roll, 3, has a smooth surface, and a second roll, 4, has a surface with an engraved pattern. This can be for example in the form of a plurality of cavities in the shape of square-based pyramids with base edges of each contiguous with the edges of adjacent cavities. Other configurations can of course be devised by a person of skill in the art.

A metal foil, 5, is carried on the first smooth roll, 3, such that the powder mixture contacts the foil rather than the roll. A pressure is exerted between rolls, 3 and 4, such that the superabrasive/metal powder mixture is cold formed into a coherent structure with the metal foil and this structure is passed into a sintering furnace, 5, where the metal particles, superabrasive grains and the metal foil are caused to bond together. After an optional cooling stage, 6, the structure is passed to a lamination station, 7, in which it is adhered to a suitable substrate, 8, which in the process illustrated is a heavy duty polyester film, by the application of a suitable adhesive, 9, which is applied by a doctor-blade, 10, to the smooth side of the metal foil backing the structure.

What is claimed is:

1. A process for the production of an engineered abrasive which comprises:

a) forming a powder mixture of particles of a superabrasive and particles of a bonding metal;

b) depositing the mixture as a layer on a metal foil supported on a rigid surface;

c) applying forming pressure to the powder by means of a forming tool having a raised surface pattern, the applied pressure being sufficient to cause the powder and the metal foil to form a coherent sheet having first and second major surfaces, wherein the first surface has a raised pattern comprising a plurality of metal/superabrasive composites wherein the pattern is the inverse of the pattern on the forming tool, and the second surface is smooth; and d) sintering the metal particles in the composites to a porosity of the structure that is less than 20%.

2. A process according to claim 1 in which a substrate material is laminated to the second surface of the metal foil.

3. A process according to claim 1 in which the forming pressure is applied by a pair of nip rolls one of which has a patterned surface.

4. A process according to claim 1 in which the superabrasive is selected from the group consisting of cubic boron nitride and diamond.

5. A process according to claim 1 in which the superabrasive particles have average particle sizes of from 1 to 100 micrometers.

6. A process according to claim 1 in which the metal is a copper/tin alloy comprising from 5 to 50% by weight of tin.

7. A process according to claim 1 in which the metal is an alloy containing iron, nickel, cobalt, molybdenum, silver and mixtures thereof.

8. A process according to claim 1 in which the metal also contains a reactive metal selected from Ti, Zr, Cr, Mo, Ta, Hf, Nb, or Mn to provide a chemical bond between the superabrasive grains and the metal.

9. A process according to claim 1 in which the superabrasive comprises from 5 to 50% of the volume of the superabrasive metal powder mixture.

10. A process according to claim 3 in which the pressure exerted between the rolls is from 207 to 690 MPa.

11. A process according to claim 2 in which the substrate material is a polymer film.

12. A process according to claim 2 in which the substrate material is a woven fabric.

* * * * *